US005609196A

United States Patent [19]

Kraler

[11] Patent Number: 5,609,196

[45] Date of Patent: Mar. 11, 1997

[54] ROLLER BLIND SYSTEM

[76] Inventor: Franz Kraler, A-9913 Abfaltersbach 125, Austria

[21] Appl. No.: 675,811

[22] Filed: Jul. 5, 1996

Related U.S. Application Data

[63] Continuation of Ser. No. 320,067, Oct. 7, 1994, abandoned.

[30] Foreign Application Priority Data

Oct. 11, 1993 [AT] Austria ..... 2030/93
Sep. 9, 1994 [AT] Austria ..... 282/94

[51] Int. Cl.[6] ..... E06B 9/17

[52] U.S. Cl. ..... 160/271; 160/23.1; 160/26; 160/323.1

[58] Field of Search ..... 160/266, 238, 160/267.1, 268.1, 271, 270, 323.1, 23.1, 26

[56] References Cited

U.S. PATENT DOCUMENTS

| | | | |
|---|---|---|---|
| 3,196,935 | 7/1965 | Christensen | 160/267.1 |
| 4,122,559 | 10/1978 | Kelly | 160/23.1 X |
| 4,399,855 | 8/1983 | Volfson | 160/23 R |

FOREIGN PATENT DOCUMENTS

| | | | |
|---|---|---|---|
| 352369 | 9/1979 | Austria | E06B 9/02 |
| 150000 | 7/1985 | European Pat. Off. | E06B 9/20 |
| 254922 | 2/1988 | European Pat. Off. | E06B 9/20 |
| 4002250 | 8/1991 | European Pat. Off. | E06B 9/17 |
| 0507136 | 10/1992 | European Pat. Off. . | |
| 2225037 | 10/1974 | France | E06B 9/20 |
| 2343117 | 9/1977 | France | E06B 9/17 |
| 2403445 | 4/1979 | France | E06B 9/17 |
| 2425530 | 12/1979 | France | E06B 9/17 |
| 2635141 | 10/1990 | France | E06B 9/174 |
| 2612318 | 6/1981 | Germany | E06B 9/17 |
| 8914394 | 2/1990 | Germany | E06B 9/17 |
| 4106390 | 9/1992 | Germany | E06B 9/58 |
| 619285 | 9/1980 | Switzerland | E06B 9/17 |

*Primary Examiner*—Philip C. Kannan
*Attorney, Agent, or Firm*—Lorusso & Loud

[57] ABSTRACT

A roller blind system with two lateral guide members for a draw-up mechanism or a mounting or the like of a roller blind, wherein the carrier members can each be connected to the respective lateral guide rails for the roller blind shuttering and are designed for carrying the draw-up mechanism or the mounting or the like. The roller blind system includes for each carrier member at least one cover means which can be fixed at the end on the outside to the respective carrier member.

19 Claims, 12 Drawing Sheets

ROLLER BLIND SYSTEM

This application is a continuation of copending application Ser. No. 08/320,067 filed on Oct. 7, 1994, now abandoned.

The invention concerns a roller blind system with two lateral carrier members for a draw-up mechanism or a mounting or the like of a roller blind, wherein the carrier members can each be connected to the respective lateral guide rails for the roller blind shuttering and are designed for carrying the draw-up mechanism or the mounting or the like.

Roller blinds can be used either as so-called finished or ready-made roller blinds or as build-in roller blinds. In the case of the ready-made roller blinds essentially visible roller blind casing structures are fixed on the outside above a window or a door while in the case of build-in roller blinds the technical components of the draw-up mechanism and the lateral carrier members which carry same are arranged in a downwardly open but otherwise closed receiving opening or compartment in the masonry.

The object of the present invention is to provide a roller blind system which is as flexible as possible.

In accordance with the invention that is achieved in that the roller blind system includes for each carrier member at least one cover means which is separate from the carrier member and which can be fixed at the end on the outside to the respective carrier member. in French patent specification No. 2 403 445 there is a carrier member which is of a trap-part construction comprising the parts 8 and 9. The part 8 is connected to the lateral guide rails. The part 9 which at the same time forms the lateral end face carries the draw-up mechanism or a mounting for the winding shaft. In contrast to the functionally passive cover means according to the invention the lateral end face part in accordance with French patent specification No. 2 403 445 is functionally essential for it carries the winding shaft. This therefore does not involve a pure cover means which is separate from the carrier member, but on the contrary the part 9 forms a part of the carrier member.

By virtue of such a design configuration, it is possible to fix selectively no cover means to the structurally and functionally involved carrier members (in the case of build-in roller blinds) or to fix selectively according to the respective requirements involved different cover means to the carrier member on the outside thereof (so-called ready-made roller blinds). In the case of the ready-made roller blind walls surrounding the winding shaft, of a roller blind casing structure, may then additionally be provided. By virtue of the construction according to the invention therefore, from the point of view of the structurally and functionally technical components, there is no longer any need to make a distinction between built-in roller blinds and ready-made roller blinds. If necessary a functionally passive cover means is simply fixed on the outside to the carrier member, preferably by welding or glueing.

The cover plates may be adapted to the respective conditions involved, both in respect of shape and also in respect of size. Besides adaptation of the cover plates it is also possible to provide two or more different carrier members, for example for adaptation to different winding diameters, which can be fixed selectively to the lateral guide rails for the roller blind shuttering. That therefore affords a modular system which permits easy adaptation to the respective conditions involved.

Further advantages and particulars of the invention are described in greater detail with reference to the following specific description.

FIG. 1 shows an embodiment of a roller blind according to the invention (without illustrating the winding shaft and the roller blind shuttering).

FIGS. 2, 3 and 4 respectively show a view from the inside, a view in section taken along line A—A in FIG. 2 and a plan view of an embodiment of a lateral carrier member.

Figures 8A, 8B, 8C, 9A, 9B, 9C, 10A, 10B, 10C:
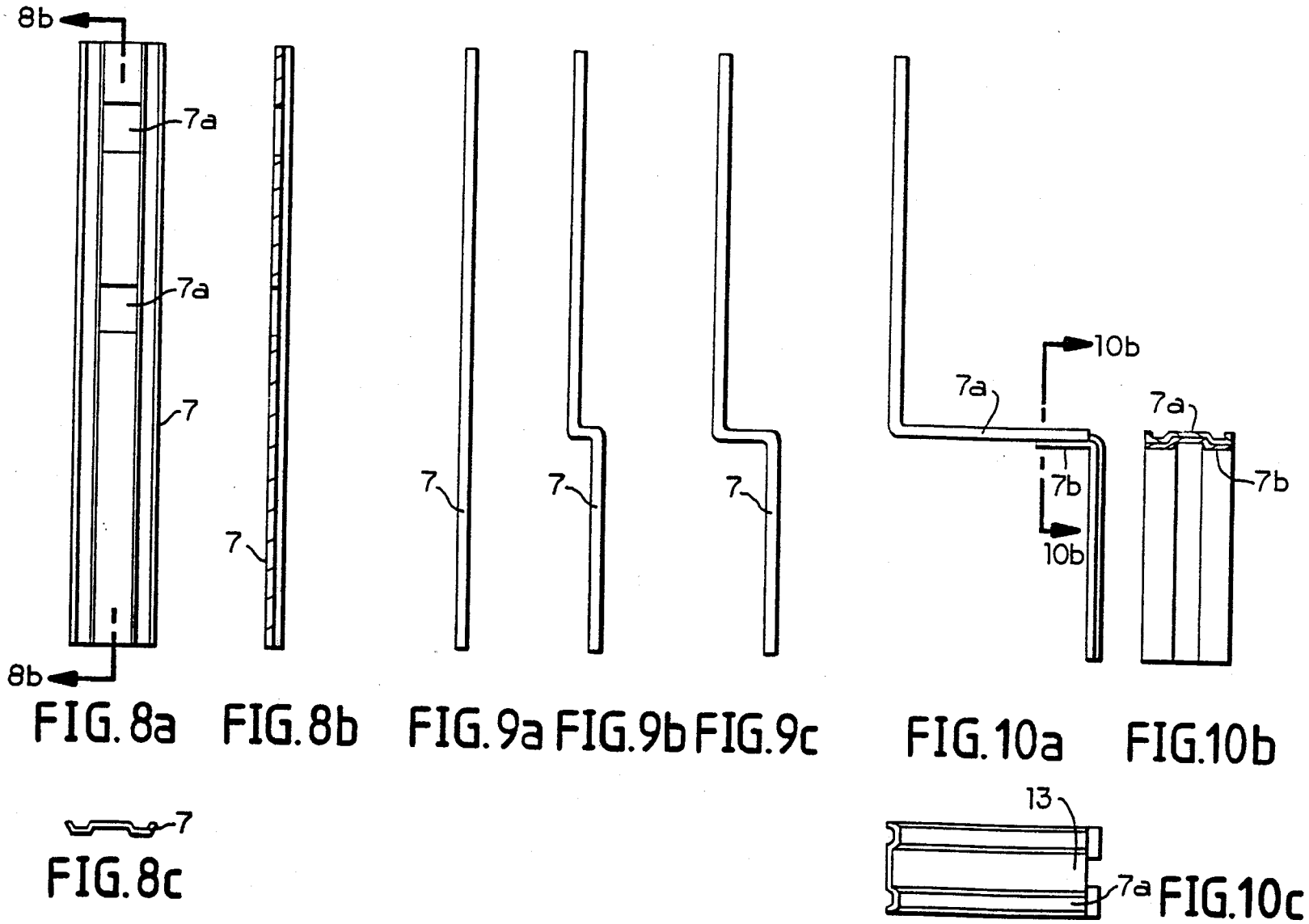

FIGS. 8*a*, 8*b* and 8*c* show a front view, a view in section taken along line A'—A' in FIG. 8*a* and a plan view of a profiled connecting element which is straight in respect of its longitudinal extent.

FIGS. 9*a*, 9*b* and 9*c* show embodiments of integral separate connecting elements.

FIGS. 10*a*, 10*b* and 10*c* show a side view, a view in section taken along line B—B in FIG. 10*a* and a diagrammatic plan view of an embodiment of an adjustable separate connecting element.

Figure 11:
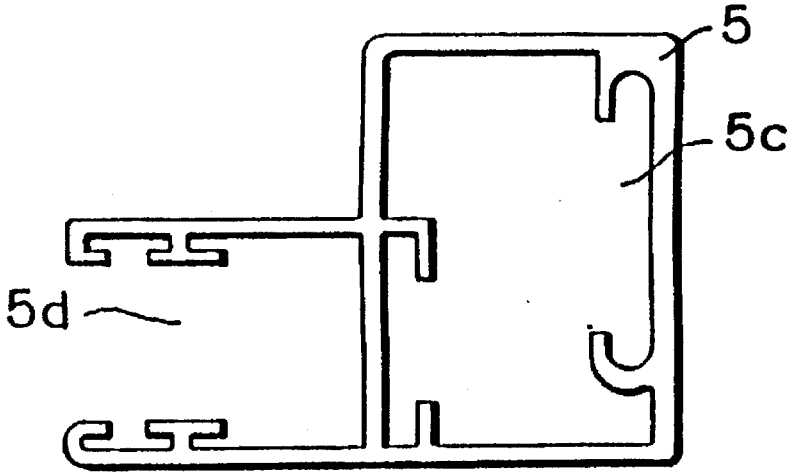
Figure 12:
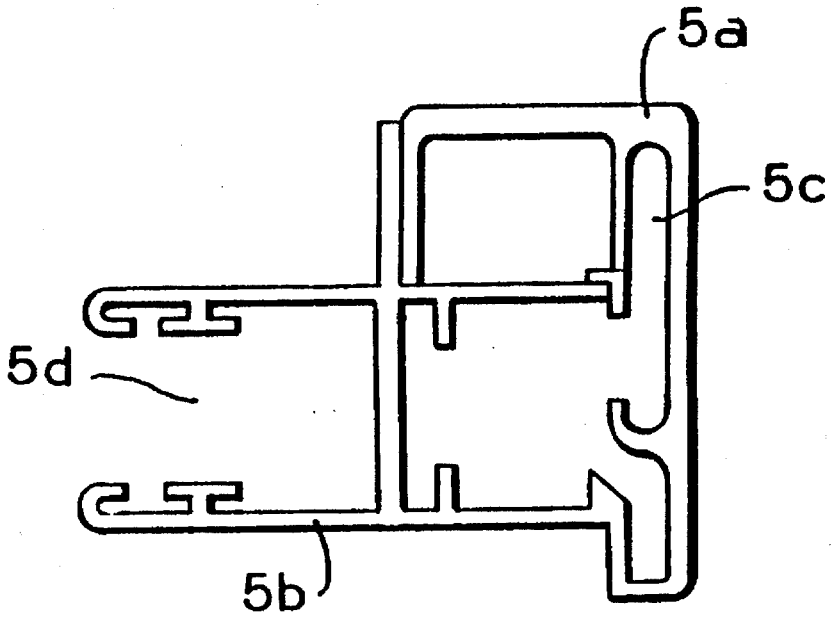

FIG. 11 and 12 show embodiments of guide rails.

Figure 13:
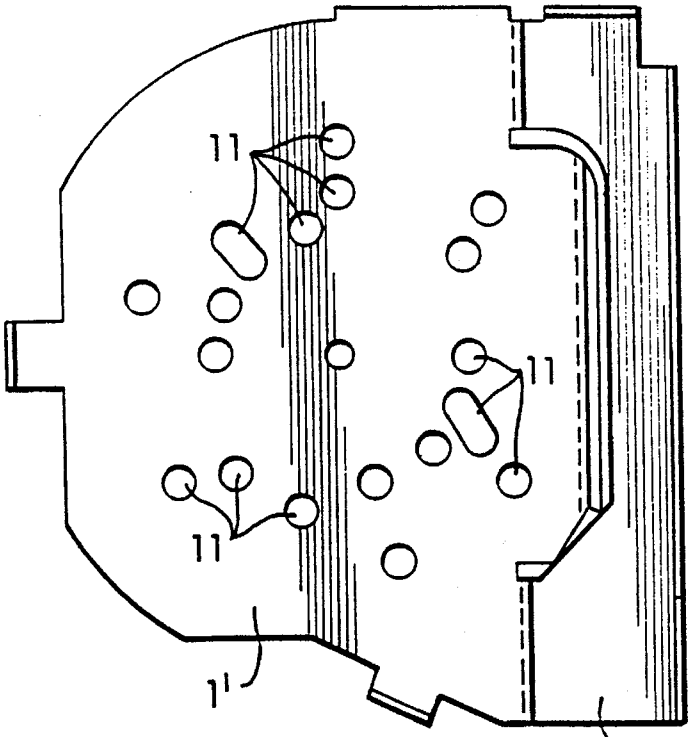

FIG. 13 shows a further embodiment of a carrier member.

Figure 15:
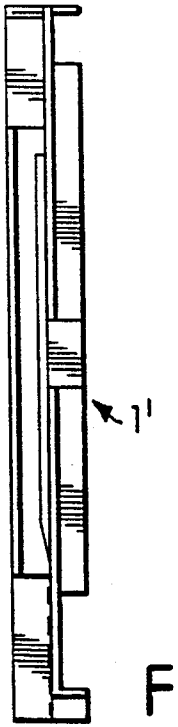
Figure 14:
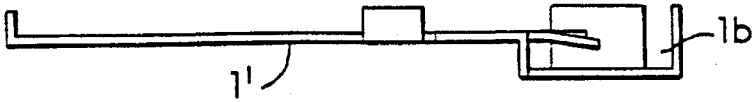

FIG. 14 shows a plan view and FIG. 15 a side view of the carrier member of FIG. 13.

Figure 16:
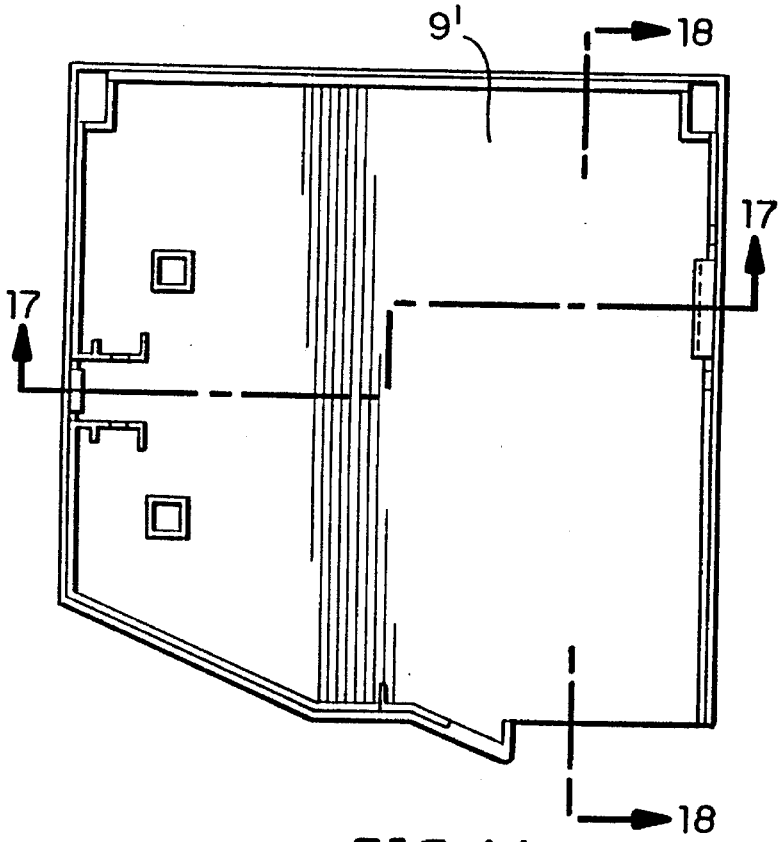

FIG. 16 shows a side view of functionally passive cover means fitting to the carrier member of FIGS. 13 through 15.

Figure 17:
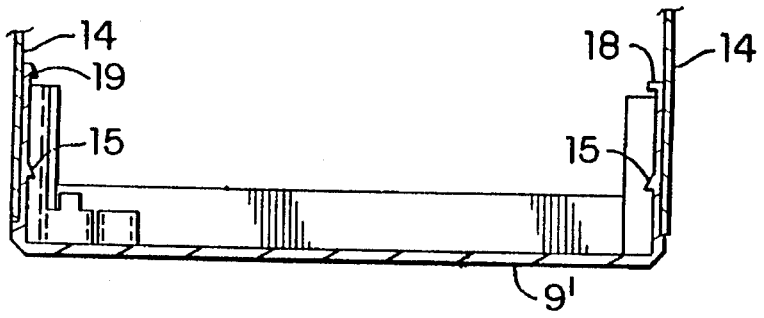

FIG. 17 shows a view in section along line A–B of FIG. 16.

Figure 18:
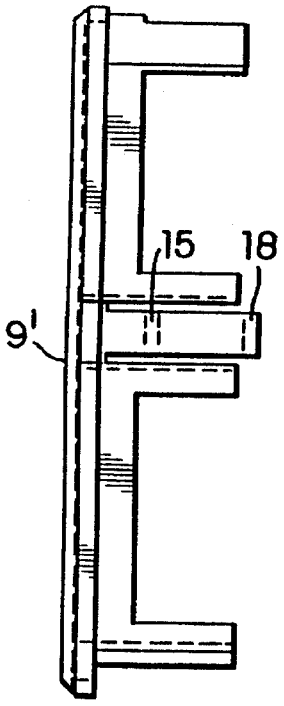

FIG. 18 shows a view in section of the cover means in FIG. 16.

Figure 19A:
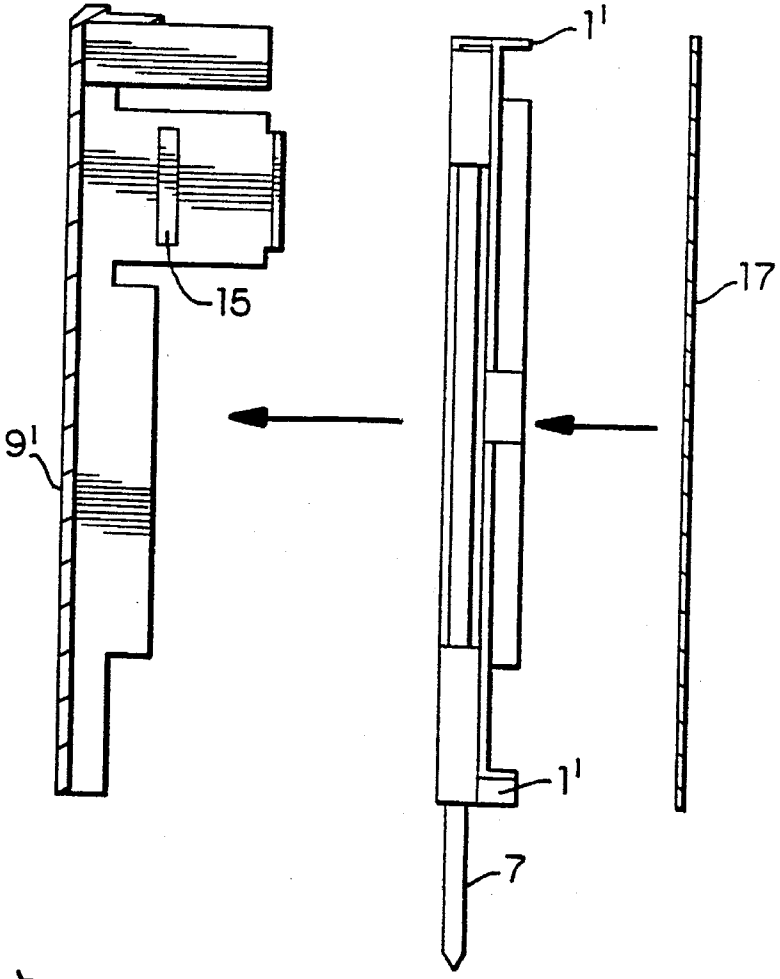
Figure 19:
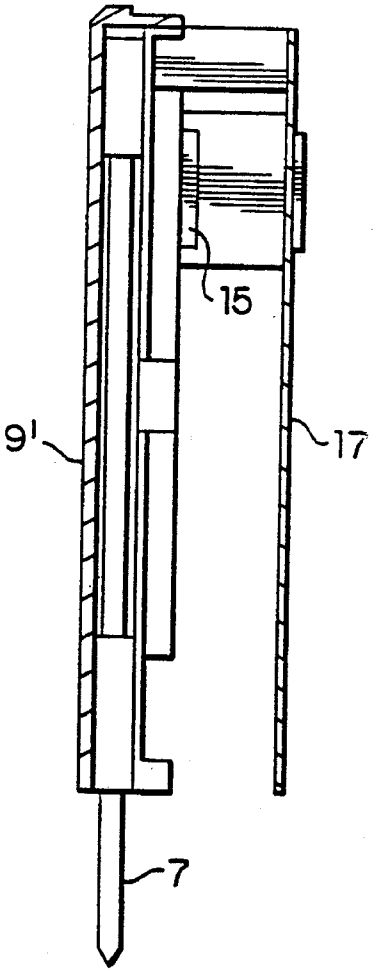

FIG. 19 shows three-part holding means with a carrier member of a cover and a flat deflecting element (corresponding to the intersection line C–D of FIG. 16).

FIG. 19*a* shows the manner in which the three-part holding means are assembled.

Figure 20A:
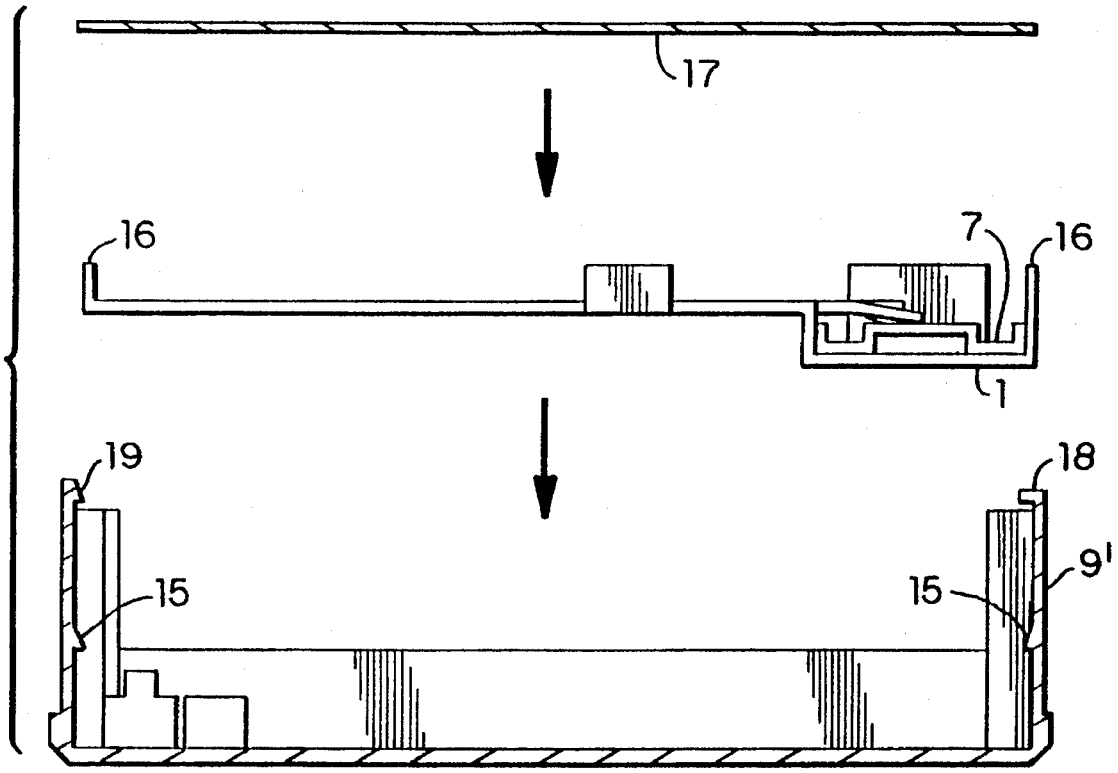
Figure 20:
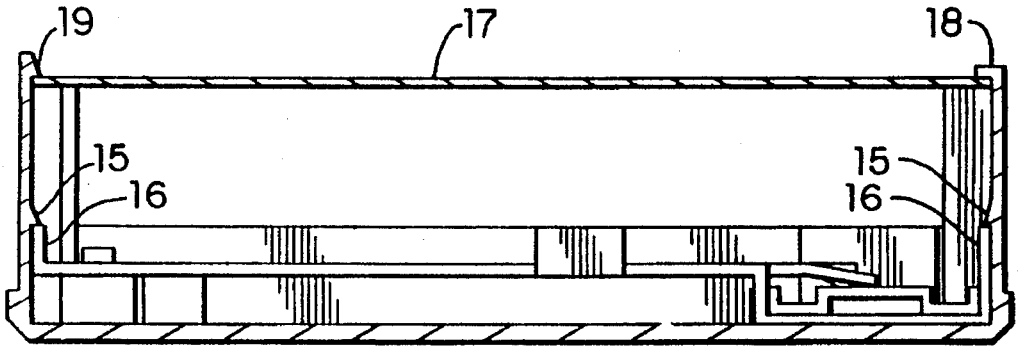

FIG. 20 shows a horizontal view in section of the same three-part holding means (corresponding to line A–B of FIG. 16).

FIG. 20*a* shows in this sectional view the manner in which the three parts are assembled.

FIGS. 21 through 24 show embodiments illustrating the ways in which different cover means can be snapped or clamped onto a carrier member.

Figure 1:
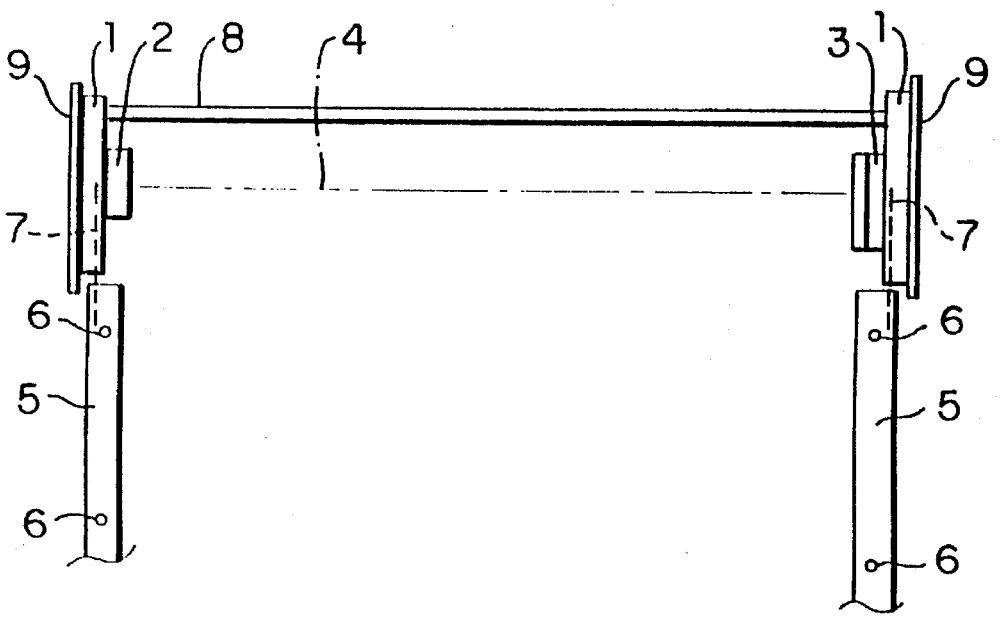

The roller blind shown in FIG. 1 has two lateral carrier members 1 which carry a mounting 2 or a draw-up or raising mechanism 3. A winding shaft with axis 4 can be driven by way of the draw-up mechanism 3 and a draw-up element (not shown) and thus a roller blind shuttering (also not shown) can be wound up. The roller blind shuttering is guided in lateral guide rails 5 which are fixed for example by means of fixing screws 6 to a door or window frame. The carrier members 1 are releasably connected to the guide rails 6 by way of separate connecting elements 7. In FIG. 1 the separate connecting elements are illustrated only diagrammatically by broken lines. A closer description thereof is set forth in relation to FIGS. 6 through 10*c*.

If the winding shaft is not enclosed by a roller blind casing structure, it may be desirable, for the purposes of enhancing stability, if the two carrier members 1 are connected together by a connecting bar 8.

The roller blind shown in FIG. 1 is in principle suitable both as a built-in roller blind and also as a finished or ready-made roller blind, in which respect all operationally important elements can be the same in both cases. In the case of a built-in roller blind the carrier members 1 are fitted in an already existing compartment or opening in the window or door lintel member and possibly only downwardly faced over. The entire draw-up mechanism together with the carrier members and the winding shaft is therefore scarcely visible. In that case the two carrier members can be arranged completely unencased receiving compartment or opening. If however the roller blind is to be used as a so-called ready-made roller blind which is typically subsequently fitted above windows or doors in such a way as to be visible from the outside, it is easily possible to mount an end cover 9 externally at each carrier member 1, more specifically without altering the other structurally and operationally important elements. Furthermore a roller blind casing structure wall may be provided between the two covers 9 in order to conceal the winding shaft, the mounting 2 and the draw-up mechanism 3 in the interior. It is possible for different kinds of covers 9 to be fixed on the outs rode to the respective carrier member, according to the particular requirements involved, for one and the same roller blind system, with the same or similar carrier members 1.

Figure 3:
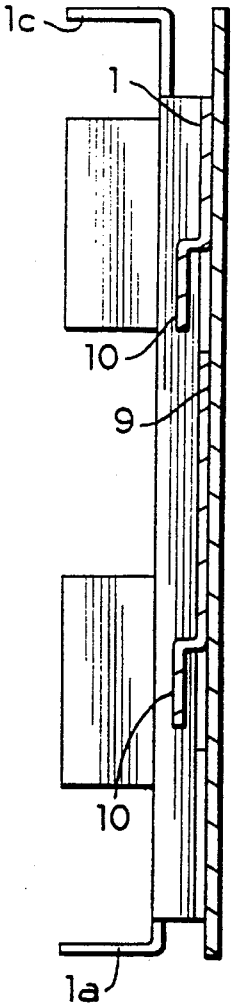
Figure 2:
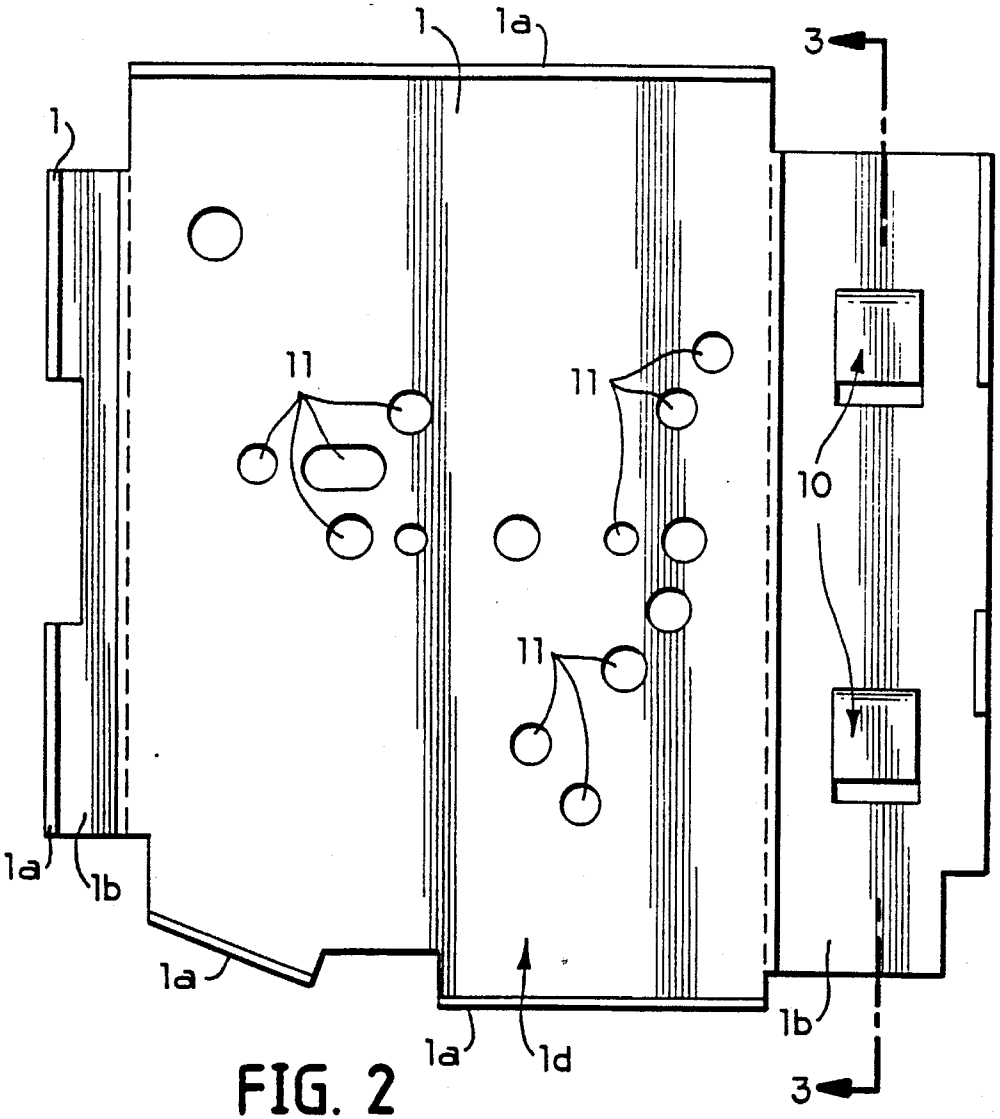
Figure 4:
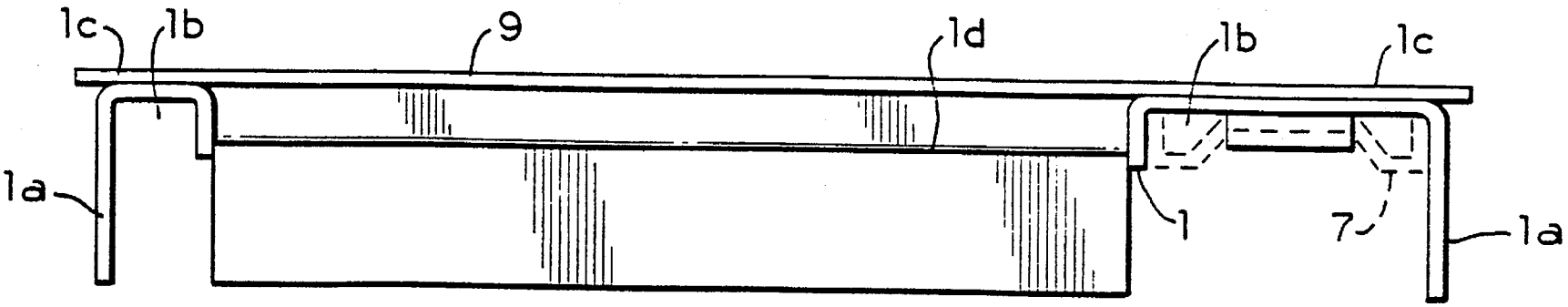

The carrier members 1 may be for example of the configuration shown in FIGS. 2 through 4. The carrier members 1 illustrated therein are integral and comprise stamped sheet metal. That means that they are easy and inexpensive to produce. In order to enhance stability the carrier members 1 have angled legs la at the edge. They also permit easy fixing of a wall forming the roller blind casing structure, between two lateral carrier members 1. On the left and on the right in FIGS. 2 and 4, the carrier members 1 have profile channels 1*b* for enhancing stability. The profile channel 1*b* which is at the right in FIGS. 2 and 4 also serves to receive a connecting element 7, as is shown for example in FIGS. 8*a* through 8*c*. The connecting element 7 serves to connect the carrier member 1 to the guide rails 5. In order to provide for a stable connection of the connecting element 7 to the carrier member 1, two lugs 10 are stamped out in the carrier member 1 and are bent inwardly and downwardly within the profile channel 1*b*. The connecting element 7 has openings at the spacing of the two lugs 10 and can thus be inserted from below into the lugs.

At a region 1*d* which is set back relative to the end faces 1*c*, the carrier member shown in FIGS. 2 through 4 has a plurality of through openings 11. The draw-up mechanism, the mounting or the like can then be screwed from the outside through the through openings 11 to the carrier member 1, in which case the screw heads do not project beyond the faces 1*c*. That makes it possible for simple flat cover plates 9 to be mounted to the end faces 1*c*, if that is advantageous for visual or technical reasons. The cover plate 9 can preferably be screwed or glued to the carrier member 1, but releasable connections are certainly also conceivable and possible.

It is possible for the roller blind system to be of a modular structure in regard to the carrier members, in other words, the region of the profile channel 1*b* and the stamped-out lugs are always of the same configuration in different carrier members so that they always fit the same separate connecting elements 7. However the remainder of the configuration of the carrier member may vary greatly, for example in regard to size for adaptation to different winding diameters. However, even in the case of one and the same carrier member, by virtue of the numerous pre-bored through openings 11, it is possible to fix different kinds of draw-up mechanisms, mountings or the like, without altering the carrier member.

Figure 5:
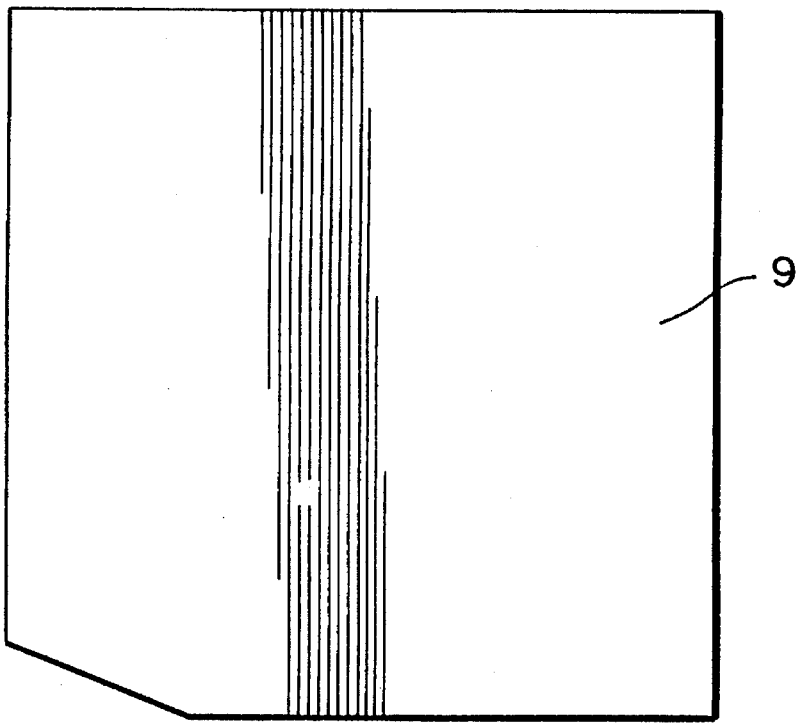
FIG. 5 shows a side view of a lateral cover.

An embodiment of a flat cover plate 9 is shown in FIG. 5.

Figure 6:
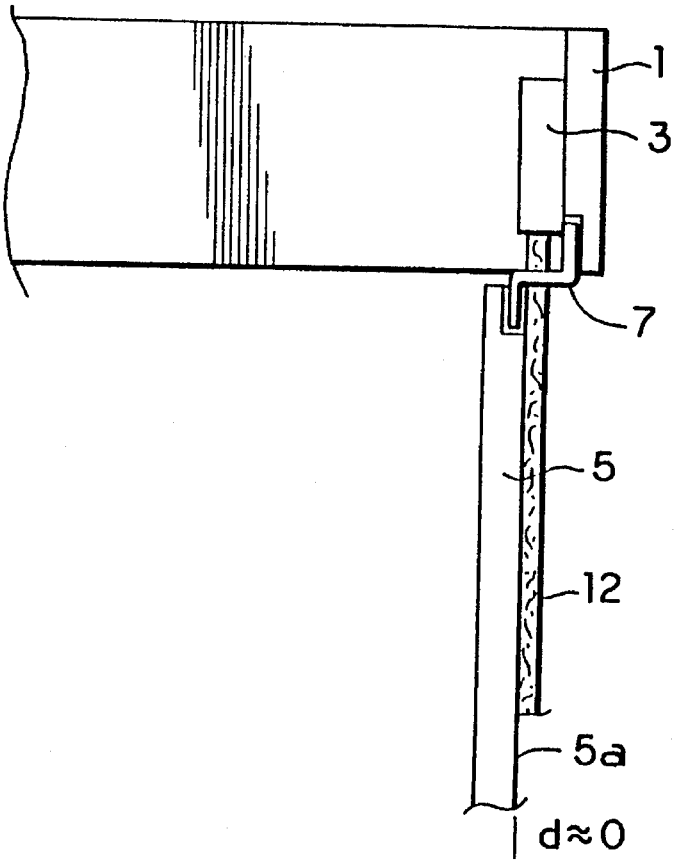
FIGS. 6 and 7 are diagrammatic views of embodiments for the connection of a carrier member and a guide rail by means of two different separate connecting elements.
Figure 7:
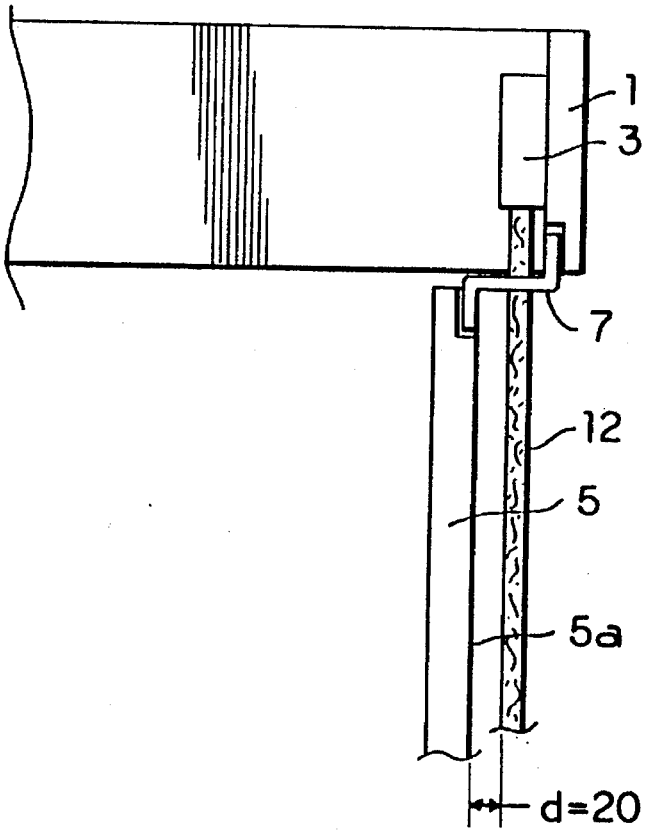

FIGS. 6 and 7 show how a different relative position as between the guide rail 5 and the carrier member 1 can be achieved by way of different separate connecting elements 7, with the structure otherwise being the same. It is possible in that way to adapt the lateral spacing between a draw-up element 12 (for example a draw-up or raising belt) and the outside edge 5*a* of the guide rail, depending on local conditions. In FIG. 6 that spacing d is approximately zero, that is to say the draw-up element 12 extends substantially along the outside edge 5*a* of the guide rail 5. That is possible by virtue of a connecting element 7 which is of a Z-shaped profile and which is fitted both in the carrier member 1 and also in the guide rail 5 and which is releasably connected thereto. The releasable push-in connection is only diagrammatically shown in FIGS. 6 and 7. A larger spacing between the draw-up element 12 and the guide rail 5 is easily achieved by using a separate connecting element 7 which is also Z-shaped but which, as shown in FIG. 7, has a longer horizontal leg.

in the embodiment shown in FIGS. 8*a* through 8*c* the separate connecting element is overall straight, but it is profiled in cross-section (see in particular FIG. 8*c*) in order to increase stability. The connecting element may comprise for example metal or reinforced plastic material. In the embodiment shown in FIGS. 8*a* through 8*c* the connecting element 7 has two openings 7*a* which are suitable for being engaged into the lugs 10 in FIG. 3 from below. The connecting element 7 then lies snugly and fully in the profile channel 1*b*, as shown in FIG. 4.

Simple configurations of I-shaped and Z-shaped connecting elements are shown in FIGS. 9*a* through 9*c*.

While the connecting elements shown hitherto were of a one-piece configuration and thus permit inexpensive manufacture, FIGS. 10*a* through 10*c* show a somewhat more expensive design. The connecting element illustrated there is of a two-part configuration, wherein two L-shaped Darts are assembled overall to form a Z-shaped connecting element. The horizontal leg 7*a* of the one part and the horizontal leg 7*b* of the other part overlap in the middle region, the degree of overlap being adjustable. In that way it is possible to adjust the effective length of the horizontal limb of the connecting element which overall is of a Z-shaped profile. A screw can serve for fixing the relative position of the legs 7*a* and 7*b*, the screw being screwed through both legs 7*a* and 7*b*, for example at the location indicated by a cross 13 in FIG. 10*c*.

Besides a set of different separate connecting elements or adjustable connecting elements and possibly beside various carrier members which match same, the roller blind system according to the invention may additionally also have different kinds of guide rails in order to provide for optimum adaptation to the respective conditions involved. The guide rails are then distinguished in that they have a connecting region 5*c* which is always of the same configuration, irrespective of the rest of the structure of the guide rail, and which therefore always matches the same or similar separate connecting elements (see FIGS. 11 and 12). FIG. 11 shows an integral embodiment of a guide rail 5. The separate connecting element 7 can be inserted into the region 5*c* from above. The region 5*d* serves to guide the actual roller blind.

FIG. 12 shows a two-part embodiment of the guide rail. The first part 5*a* has the connecting region 5*c* for the connecting element 7 while the second part 5*b* which is fixed thereto has the guide 5*b* for the actual roller blind shuttering. The two-part configuration shown in FIG. 12 advantageously makes it possible to fit different kinds of further parts 5*b* to one and the same basic part 5*a* with connecting region 5*c*, depending on the roller blind thickness etc.

The carrier member 1' shown in FIGS. 13 through 15 has numerous prefabricated bores, partly in the form of longitudinal holes, through which mountings or draw-up mechanisms (not illustrated) of the roller blind are screwable to the carrier member. Furthermore, the carrier member 1' has a profile channel 1*b* into which a separate connecting element 7 (not illustrated) can be pushed to connect the carrier member 1' with a lateral guide rail for the roller blind shuttering.

While in the embodiment according to FIGS. 2 through 4 cover means are provided in the form of a flat metal plate 9, a one-piece plastic member 9' produced preferably by means of injection molding is provided as a cover in the embodiment according to FIGS. 16 through 18. Said plastic member 9' is, as will be described below in more detail, releasably connectable with the carrier member of FIGS. 13 through 15 to cover the end face, which is the outer one in the mounted condition, of the carrier member 1'. The cover 9' serves essentially to provide an aesthetical appearance. Moreover, the cover 9' which is functionally passive in view of a carrying function for the winding shaft of the roller blind shuttering may serve as a holding means for a wall 14 (FIG. 17) which forms the actual roller blind casing in which the winding shaft for the roller blind shuttering is accomodated. Said wall 14 may through the functionally essentially passive cover be screwed to the supporting carrier member 1' lying underneath.

For connecting the cover 9' with the carrier member 1', the cover 9' simply has to be pushed onto the carrier member 1', or vice versa, the carrier member 1' has to be pushed onto the cover 9', as shown in FIGS. 19*a* and 20*a*. Advantageously, there is provided a self-locking connection between the cover 9' and the carrier member 1', i.e. a snap or clamp connection, which locks automatically, when parts 1' and 9' are moved together, and thus holds said parts together.

In the illustrated embodiment, the cover 9' has for this purpose resilient catch elements (noses) 15 which engage automatically in a counter catch on the carrier member 1', when the cover 9' and the carrier member 1' are brought together. In the illustrated embodiment, said counter catch is formed by the edges 16 of the carrier member 1'. FIG. 20 shows clearly the way in which the catch noses 15 engage behind the edges 16. The resilient yielding of the catch elements 15, before they engage behind the counter catch 16, is possible simply due to the fact that the cover 9' is a plastic member, the material having a corresponding elasticity.

In the embodiment shown in FIGS. 19, 19*a*, 20 and 20*a*, there is further provided a deflecting element 17 in the form of a flat plate. Said deflecting element lies in the assembled roller blind casing in the interior thereof and serves, during winding, to laterally guide or deflect the roller blind shuttering. The deflecting element 17 can via the cover 9' be connected with the carrier member 1' to form three-part holding means. For this purpose, the plate 17 is inserted below the angled end 18 of the cover 9' and then pivoted, thereby engaging behind the catch 19.

Figure 21:
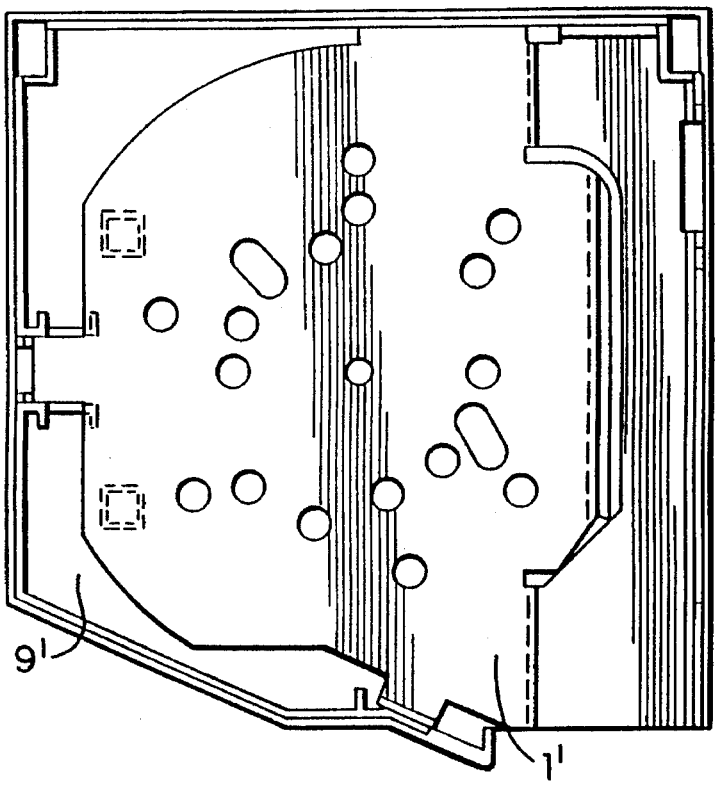
Figure 22:
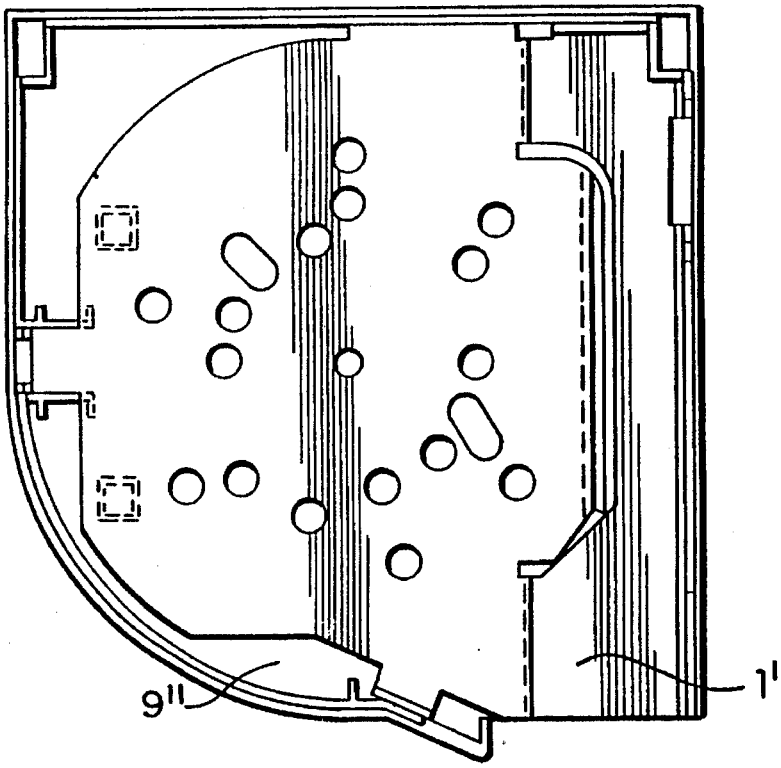
Figure 23:
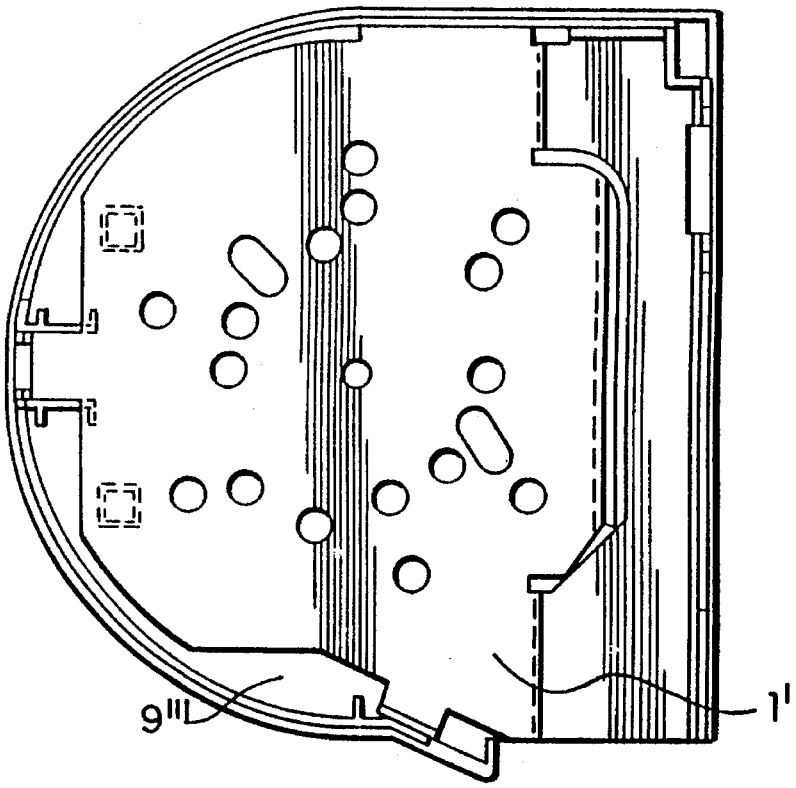
Figure 24:
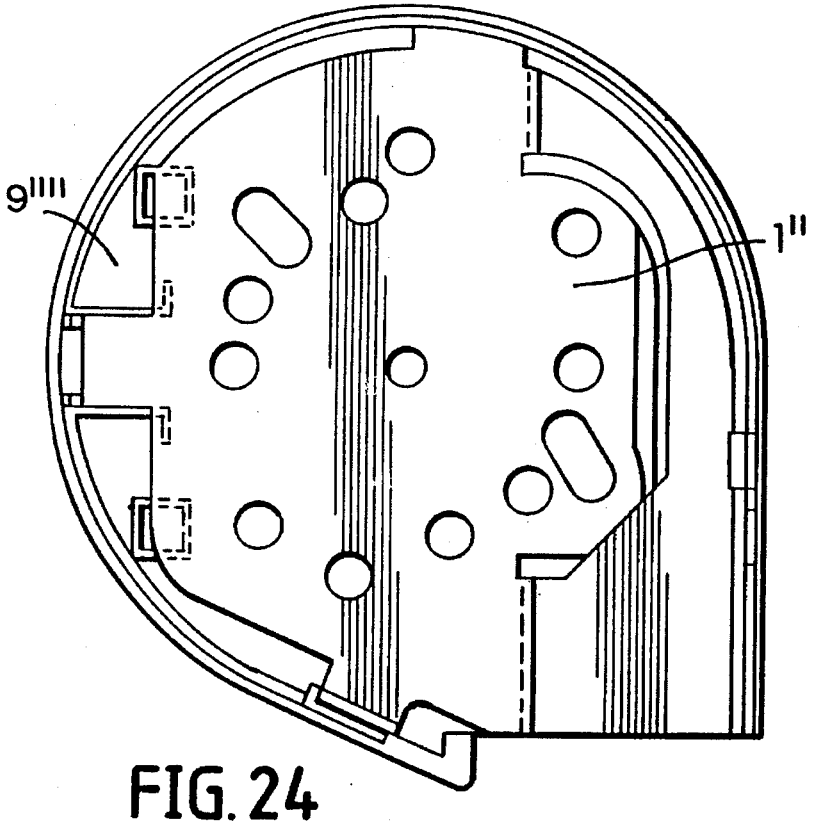

FIGS. 21 though 23 show the way in which different covers 9', 9" and 9'" are connectable to one and the same carrier member 1' to obtain and laterally cover different shapes of roller blind casings. In the embodiment shown in FIG. 24, a carrier member 1" of slightly different configuration is provided, and a cover –9'" is releasably fastened thereto.

The invention can be sold as a complete roller blind system. It is also possible, however, to put the holding means for a draw-up mechanism or a mounting of a roller blind separately on the market. According to the invention, such holding means have a two-part structure comprising a carrier member designed for carrying the draw-up mechanism or a mounting, and a cover preferably releasably connected thereto.

In a further embodiment, the holding means for the draw-up mechanism or the mounting of a roller blind consist of three parts and comprise said carrier member of said cover and additionally a deflecting element, which is arranged at the inner side of the carrier member, for the roller blind shuttering.

I claim:

1. A roller blind system comprising:

a winding shaft for carrying a roller blind shuttering;

a draw-up mechanism for operating said winding shaft to wind said roller blind shuttering thereon;

two lateral guide rails in which the roller blind shuttering is guided;

two lateral carrier members, each of said carrier members being connected to a respective one of said lateral guide rails for carrying the draw-up mechanism and a mounting;

at least one cover plate for each of said carrier members which is separate from said carrier members and which can be fixed on the outside of said carrier members; and a functionally passive roller blind casing housing said draw-up mechanism, said mounting, said carrier members, and said winding shaft, wherein said roller blind system can be used as a ready-made roller blind when said cover plates are fixed to said carrier members and said roller blind casing is attached for housing said draw-up mechanism, said mounting, said carrier members and said winding shaft, and wherein said roller blind system can be used as a build-in roller blind when said cover plates and said roller blind casing are removed.

2. A roller blind system as set forth in claim 1 characterized in that for each of the carrier members it includes a plurality of different functionally passive cover plates, each of which are selectively connectable to the respective carrier member.

3. A roller blind system as set forth in claim 1 characterized in that it includes a plurality of different carrier members, each of which are selectively connectable to the guide rails.

4. A roller blind system as set forth in claim 3 characterized in that the carrier members have a similar connecting element for releasably connecting the carrier members to the respective guide rails.

5. A roller blind system as set forth in claim 4 characterised in that it includes a plurality of different separate connecting elements, of which a respective one, depending on the respectively desired relative position of the guide rail and the carrier member, can be selected and used for connecting the guide rail and the carrier member.

6. A roller blind system as set forth in claim 4 characterized in that each of said carrier members includes a profile channel formed therein for receiving a separate connecting element, by way of which said guide rails can be connected to said carrier members.

7. A roller blind system as set forth in claim 1 characterized in that the carrier member has a plurality of through openings at a flat region which is set back inwardly relative to an end face thereof, said draw-up mechanism and said mounting being releasably attachable to said carrier member by screws inserted through said through openings.

8. A roller blind system as set forth in claim 1 characterized in that the cover plates are flat plates.

9. A roller blind system as set forth in claim 1 characterized in that the cover plates are glued to the carrier members.

10. A roller blind system as set forth in claim 1 characterized in that the cover plates are releasably fastened to the carrier members.

11. A roller blind system as set forth in claim 1 characterized in that the cover plates are pushed onto the carrier members.

12. A roller blind system as set forth in claim 1 characterized in that the cover plates are connected with the carrier members by a self-locking connection.

13. A roller blind system as set forth in claim 12, characterized in that the cover plates have at least one resilient catch element automatically engaging a counter catch on the carrier members when the cover plates are mounted to the carrier members, thus holding the cover plates and carrier members together.

14. A roller blind system as set forth in claim 1, characterized in that the cover plates are preferably one-piece plastic members.

15. A roller blind system comprising:

a roller blind shuttering;

a draw-up mechanism for operating a winding shaft of the roller blind shuttering;

two lateral guide rails in which the roller blind shuttering is guided;

two lateral carrier members which are connected to the respective lateral guide rails and which carry the draw-up mechanism and a mounting; and deflecting elements for the roller blind shuttering which are separate from the carrier members and releasably fastened to each carrier member adjacent opposite ends of said winding shaft and perpendicular to said winding shaft.

16. A roller blind system as set forth in claim 15, characterised in that the deflecting element is a flat plate.

17. A roller blind system as set forth in claim 15, characterized in that the deflecting element is held by a cover connected with the carrier member and having for this purpose preferably at least one catch nose.

18. A holding structure for a draw-up mechanism and a mounting of a roller blind comprising:

a carrier member for carrying the draw-up mechanism and the mounting;

a cover connected to an outer side of said carrier member remote from the draw-up mechanism; and a deflecting element for the roller blind shuttering which is separate from the carrier member and is arranged at an inner side of the carrier member adjacent an end of said winding shaft and perpendicular to said winding shaft.

19. A holding structure for a draw-up mechanism and a mounting of a roller blind comprising:

a carrier member designed for carrying the draw-up mechanism and the mounting;

a cover with a base cover plate and projecting side walls, said carrier member being inserted into said cover and releasably fixed thereto by a snap connection; and a deflecting element for the roller blind shuttering which is releasably fixed to the cover adjacent an end of said winding shaft and perpendicular to said winding shaft by a snap connection at an inner side of the carrier member.

* * * * *